US011033120B2

(12) United States Patent
Frost

(10) Patent No.: US 11,033,120 B2
(45) Date of Patent: Jun. 15, 2021

(54) DISPLAY HUTCH

(71) Applicant: WestRock Shared Services, LLC, Atlanta, GA (US)

(72) Inventor: Jerry R. Frost, Lewisville, NC (US)

(73) Assignee: WESTROCK SHARED SERVICES, LLC, Atlanta, GA (US)

( * ) Notice: Subject to any disclaimer, the term of this patent is extended or adjusted under 35 U.S.C. 154(b) by 0 days.

(21) Appl. No.: 16/437,366

(22) Filed: Jun. 11, 2019

(65) Prior Publication Data

US 2019/0380513 A1 Dec. 19, 2019

Related U.S. Application Data

(60) Provisional application No. 62/684,780, filed on Jun. 14, 2018.

(51) Int. Cl.

| | |
|---|---|
| ***A47F 5/11*** | (2006.01) |
| ***B31B 50/52*** | (2017.01) |
| ***B31B 50/62*** | (2017.01) |
| ***B31B 50/78*** | (2017.01) |
| ***B31B 50/73*** | (2017.01) |
| *B31B 120/20* | (2017.01) |

(52) U.S. Cl.

CPC ..... *A47F 5/116* (2013.01); *B31B 50/52* (2017.08); *B31B 50/624* (2017.08); *B31B 50/73* (2017.08); *B31B 50/78* (2017.08); *B31B 2120/20* (2017.08); *B31B 2241/00* (2013.01)

(58) Field of Classification Search

CPC ..... A47F 15/116; A47F 15/11; A47F 15/112; A47F 15/10; A47F 5/116; A47F 5/11; A47F 5/112; A47F 5/10; B31B 50/78; B31B 50/624; B31B 50/73; B31B 50/52; B31B 2120/20; B31B 2241/00; A47B 43/02; A47B 47/06; A47B 55/06

See application file for complete search history.

(56) References Cited

U.S. PATENT DOCUMENTS

| | | | | | |
|---|---|---|---|---|---|
| 1,602,410 | A * | 10/1926 | Hamblin | A47F 5/108 | 108/179 |
| 2,150,743 | A * | 3/1939 | Mancuso | G09F 5/00 | 211/135 |
| 4,949,851 | A * | 8/1990 | Shaffer | A47F 5/116 | 211/149 |
| 6,612,669 | B2 * | 9/2003 | Grueneberg | A47B 43/02 | 108/165 |
| 6,715,623 | B2 * | 4/2004 | Broerman | A47F 5/116 | 211/149 |
| 6,752,280 | B2 * | 6/2004 | Dye | A47F 5/116 | 108/162 |
| 7,677,433 | B2 | 3/2010 | Little | | |

(Continued)

*Primary Examiner* — Patrick D Hawn

(74) *Attorney, Agent, or Firm* — John B. Swingle; Neil G. Cohen

(57) ABSTRACT

A container includes a plurality of panels connected together at fold lines configured for extending at least partially around an interior space. The panels include a front panel, a first side panel, a back panel and a second side panel. The back panel includes a first back portion and a second back portion. At least one of the first back portion or the second back portion is free from openings. A shelf panel is foldably connected to the front panel. The first back portion is adhered to the shelf panel.

21 Claims, 8 Drawing Sheets

(56) References Cited

U.S. PATENT DOCUMENTS 7,703,864 B2 * 4/2010 Moser ..... B65D 5/5213 312/261
8,485,370 B2 * 7/2013 Dewhurst ..... A47F 5/0018 211/135
8,857,633 B2 * 10/2014 Dewhurst ..... A47F 5/0018 211/135
9,474,389 B2 * 10/2016 Pfeifer ..... A47F 5/116
9,743,783 B1 * 8/2017 Bersamin ..... A47F 5/116
9,844,282 B2 * 12/2017 Smith ..... A47F 5/112
9,907,414 B2 * 3/2018 Heuer ..... A47F 5/11
9,949,579 B1 * 4/2018 Frost ..... A47F 5/116
10,159,362 B2 * 12/2018 Smith ..... A47F 5/116
10,306,999 B2 * 6/2019 Smith ..... A47F 5/112
10,342,365 B2 * 7/2019 Frost ..... A47F 5/116
10,524,588 B2 * 1/2020 Pratsch ..... A47B 43/02
10,568,439 B2 * 2/2020 Bersamin ..... A47F 3/004
2004/0148825 A1 * 8/2004 Myers ..... A47F 5/116 40/124
2008/0169339 A1 * 7/2008 Moser ..... B65D 5/5213 229/108.1
2008/0169340 A1 * 7/2008 Sheffer ..... A47F 5/116 229/120.32
2008/0265726 A1 * 10/2008 Sheffer ..... A47B 47/06 312/259
2010/0006529 A1 * 1/2010 Groff ..... A47F 5/116 211/186
2011/0049072 A1 * 3/2011 Dewhurst ..... A47F 5/116 211/135
2013/0213915 A1 * 8/2013 Pfeifer ..... A47B 43/02 211/135
2014/0217047 A1 * 8/2014 Frost ..... B65H 45/12 211/135
2016/0066711 A1 * 3/2016 Mestres Armengol ..... A47F 5/112 211/135
2017/0079449 A1 * 3/2017 Smith ..... A47B 43/02
2018/0235381 A1 * 8/2018 Frost ..... A47F 7/145
2018/0235382 A1 * 8/2018 Frost ..... A47F 5/116
2019/0328160 A1 * 10/2019 Frost ..... A47F 5/116
2019/0343301 A1 * 11/2019 Frost ..... A47F 5/116

* cited by examiner

DISPLAY HUTCH

REFERENCE TO RELATED APPLICATION

This application claims the benefit of priority under 35 U.S.C. § 119(e) of U.S. provisional application Ser. No. 62/684,780 filed on Jun. 14, 2018, which is hereby incorporated by reference in its entirety.

BACKGROUND OF THE INVENTION

1. Field of the Invention

The present disclosure relates to displays, and more particularly to retail merchandising displays.

2. Description of Related Art

In the retail environment, various containers are provided for shipping or for display of a product, such as pop-up displays. The pre-assemblies for conventional pop-up displays usually require costly hand finishing and special machine gluing to be made prior to shipping to their retail location. Moreover, in-store set-up time for conventional pop-up displays can be time consuming.

The conventional techniques have been considered satisfactory for their intended purpose. However, there is an ever present need for improved pop-up displays. This disclosure provides a solution for this need.

SUMMARY OF THE INVENTION

A container includes a plurality of panels connected together at fold lines configured for extending at least partially around an interior space. The panels include a front panel, a first side panel, a back panel and a second side panel. The back panel includes a first back portion and a second back portion. At least one of the first back portion or the second back portion is free from openings. A shelf panel is foldably connected to the front panel. The first back portion is adhered to the shelf panel.

The first side panel can be connected to the front panel along a respective one of the fold lines. The second side panel can be connected to the front panel along a respective one of the fold lines opposite from the first side panel. The container can include an adhesion flap foldably connected to the second side panel along a fold line. The adhesion flap can overlap the second back portion of the back panel. The adhesion flap can be adhered to an exterior surface of the second back portion of the back panel. The second back portion is foldably connected to the first side panel along a fold line.

The first back portion can be slidable with respect to the second back portion. The first back portion can have a length in the longitudinal direction of the container and the second back portion can have a length in the longitudinal direction. The length of the first back portion can be less than the length of the second back portion. The first back portion can be configured to slide between a first position and a second position thereby folding the shelf panel along a fold line between the shelf panel and the front panel.

The shelf panel includes a shelf adhesion flap foldably connected to the shelf panel. An interior surface of the shelf adhesion flap can be adhered to an interior surface of the first back portion. A top edge of the first back portion can be flush with a top edge of the shelf adhesion flap. The container can include a plurality of end flaps. Each end flap can be foldably connected to a respective one of the plurality of panels.

In accordance with another aspect, a blank for a container includes a plurality of panels connected together along respective fold lines configured to be folded at least partially around an interior space. The panels include a front panel, a first side panel, a back panel and a second side panel. The back panel includes a first back portion and a second back portion. The first back portion can be connected to the second back portion along a break line.

The first side panel can be connected to the front panel along a fold line. The second side panel can be connected to the front panel along a fold line. The blank can include an adhesion flap connected to the second side panel along a fold line. The back panel can be connected to the first side panel along a fold line. The blank can include a shelf panel at least partially connected to the front panel along a fold line. The break line can be weakened to facilitate breaking the second back portion from the first back portion by at least one of a knife cut and/or perforations. The break line can be a first break line. The first back portion can be connected to the second back portion along the first break line and a second break line. The blank can include a cut portion between the first and second break lines.

In accordance with another aspect, a method of forming a container includes folding a plurality of panels of a blank connected together at fold lines at least partially around an interior space. The panels include a front panel, a first side panel, a back panel and a second side panel. The back panel includes a first back portion and a second back portion. The method includes adhering the first back portion to a shelf panel. The method includes separating the first back portion from the second back portion along a break line.

Folding the plurality of panels can include folding the back panel along a fold line between the back panel and the first side panel and folding the second side panel along a fold line between the second back portion and the front panel. The method can include adhering an interior surface of an adhesion flap to an exterior surface of the second back portion. The method can include sliding the first back portion downward and folding the shelf panel along a fold line between the shelf panel and the front panel.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
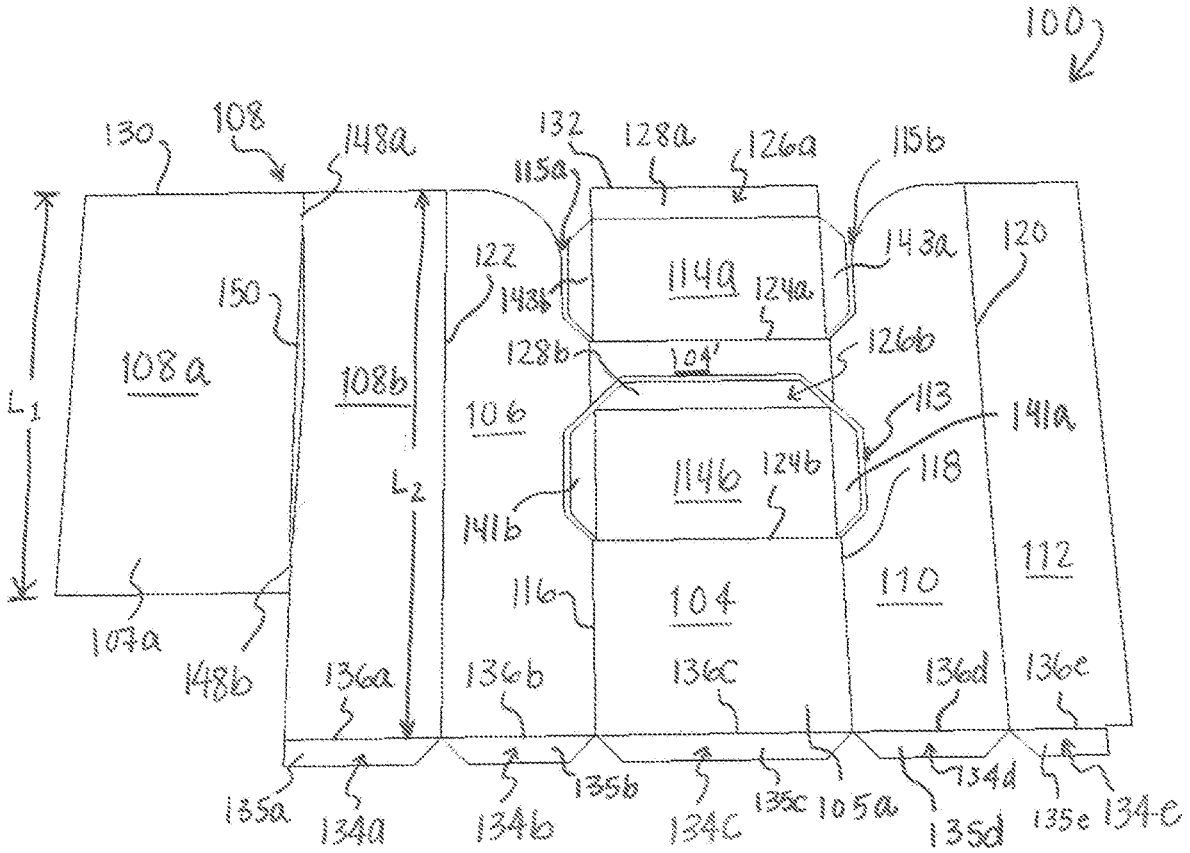
FIG. 1 is a plan view of an exemplary embodiment of a blank for a container constructed in accordance with the present disclosure, showing a back panel foldably connected to a side panel.

Reference will now be made to the drawings wherein like reference numerals identify similar structural features or aspects of the subject disclosure. For purposes of explanation and illustration, and not limitation, a partial view of an exemplary embodiment of a container in accordance with the disclosure is shown in FIG. 1 and is designated generally by reference character 100. Other embodiments of containers in accordance with the disclosure, or aspects thereof, are provided in FIGS. 2-10, as will be described. The systems and methods described herein can be used to store product and can also be converted to display product such as in a retail setting.

Figure 6A:
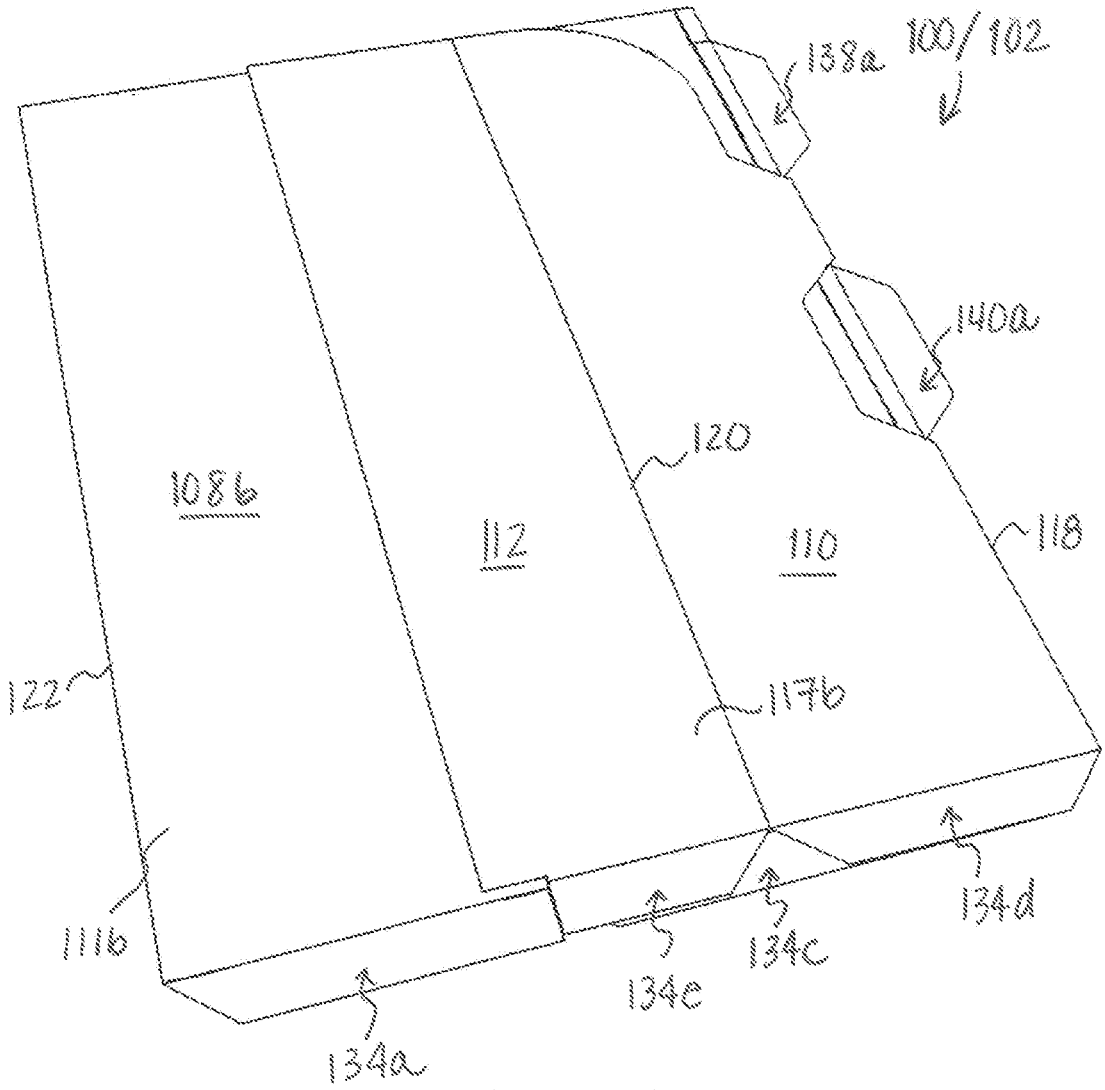
FIG. 6A is a perspective view of the blank of FIG. 1 formed into a container, showing the container from its back side in a flattened position.
Figure 7:
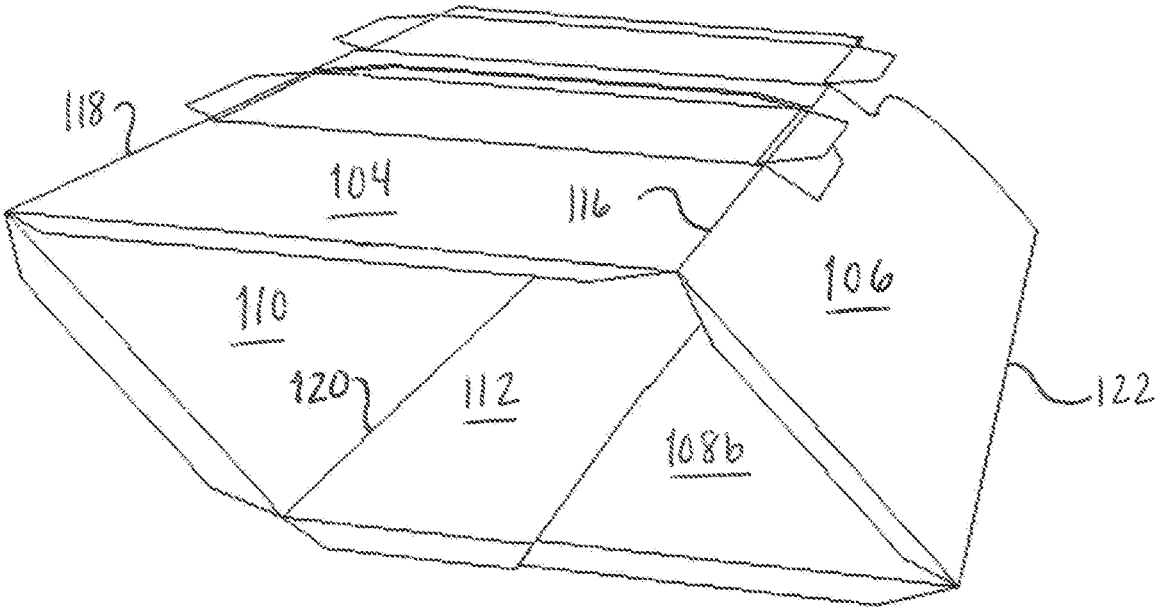
FIG. 7 is a perspective view of the container of FIGS. 6A and 6B from a bottom end, showing the panels of the container being folded along respective fold lines to enclose an interior space and erect the container.
Figure 8:
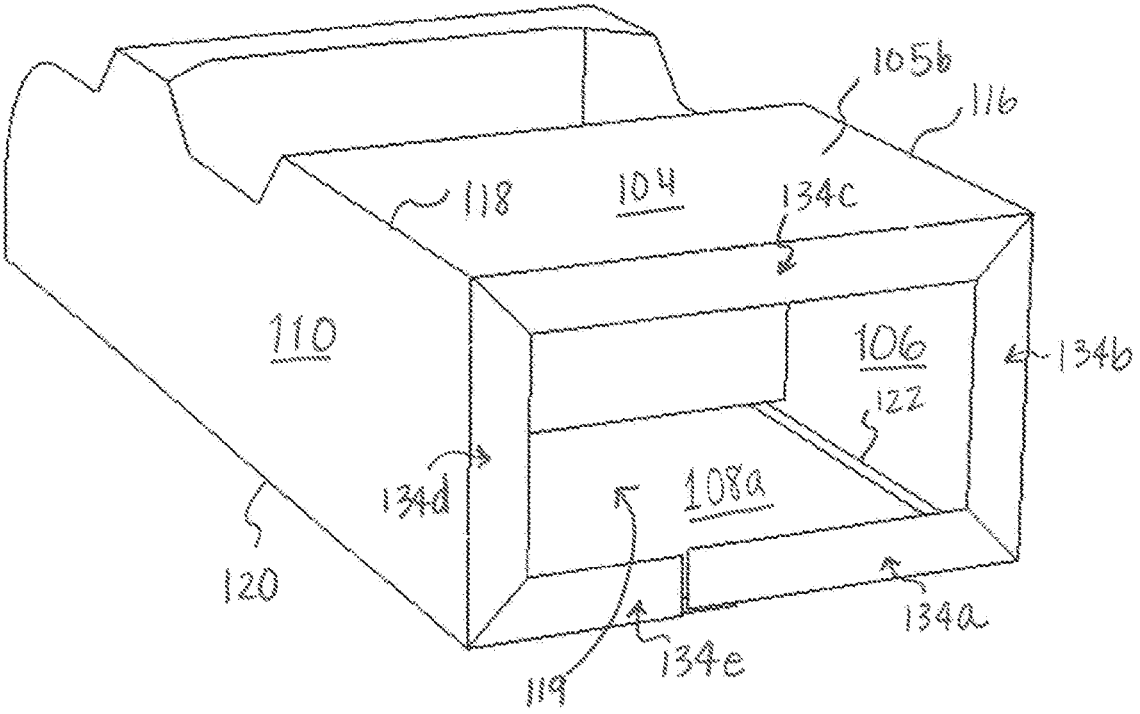
FIG. 8 is a perspective view of the container of FIGS. 6A and 6B from a bottom end, showing the panels of the container folded along respective fold lines to enclose an interior space and showing respective end flaps of the panels folded inward into the interior space.

As shown in FIG. 1, a blank 100 for a container 102 (shown in FIGS. 6A-10) includes a plurality of panels 104, 106, 108, 110, and 112 connected together at fold lines 116, 118, 120, and 122 configured to be folded at least partially around an interior space 119 (labeled in FIG. 8). The panels include a front panel 104, a first side panel 106, a back panel 108 and a second side panel 110. A plurality of end flaps 134*a*-134*e*, is included, each end flap 134*a*-134*e* is foldably connected to a respective one of the plurality of panels at respective fold lines 136*a*-136*e*. End flaps 134*a*-134*e* are configured to be folded along their respective fold lines 136*a*-136*e* to at least partially enclose a first end of the interior space 119. Blank 100 forms a hutch-style container 102 that can be used for merchandising displays at a retail location. Embodiments of blank 100 and container 102 provide for a quick set-up and do not necessarily require hand finishing.

With continued reference to FIG. 1, back panel 108 includes a first back portion 108*a* and a second back portion 108*b*. The first back portion 108*a* is connected to the second back portion 108*b* along a break line, e.g. a perforation line 148*a*. In the embodiment of FIG. 1, two break lines, e.g. perforation lines 148*a* and 148*b*, are between first back portion 108*a* and second back portion 108*b*. A cut 150 is positioned between the perforation lines 148*a* and 148*b*. Those skilled in the art will readily appreciate that any suitable number of perforation/break lines or arrangements thereof can be used. The break lines, e.g. perforation lines 148*a* and 148*b*, are weakened to facilitate breaking second back portion 108*b* from first back portion 108*a* by at least one of a knife cut and/or perforations. In the embodiment of FIG. 1, first back portion 108*a* and second back portion 108*b* are free from openings, such that each back portion 108*a*' and 108*b*, on its own, is a solid panel without openings such as apertures or cuts.

Figure 2:
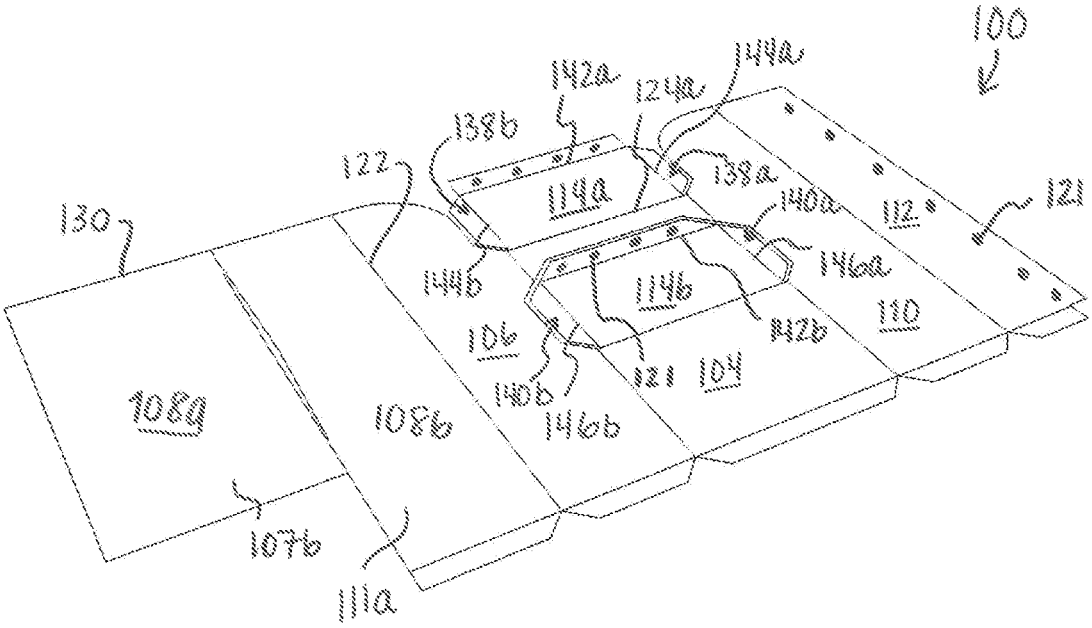
FIG. 2 is a perspective view the blank of FIG. 1, showing the back panel having first and second back panel portions.
Figure 9:
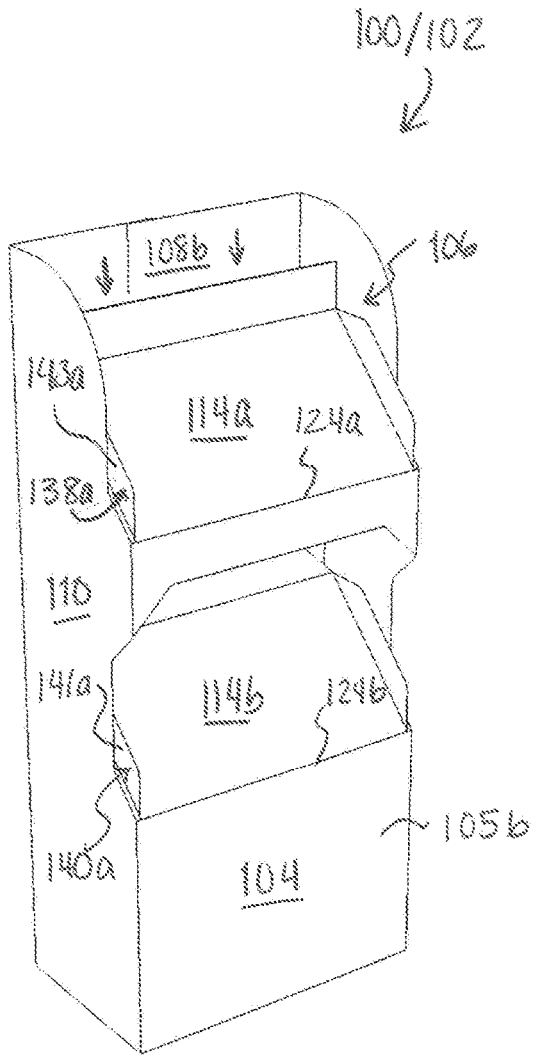
FIG. 9 is an upright front perspective view of the container of FIGS. 6A and 6B, with the first back portion and shelf panels partially slid down relative to the second back panel portion.
Figure 10:
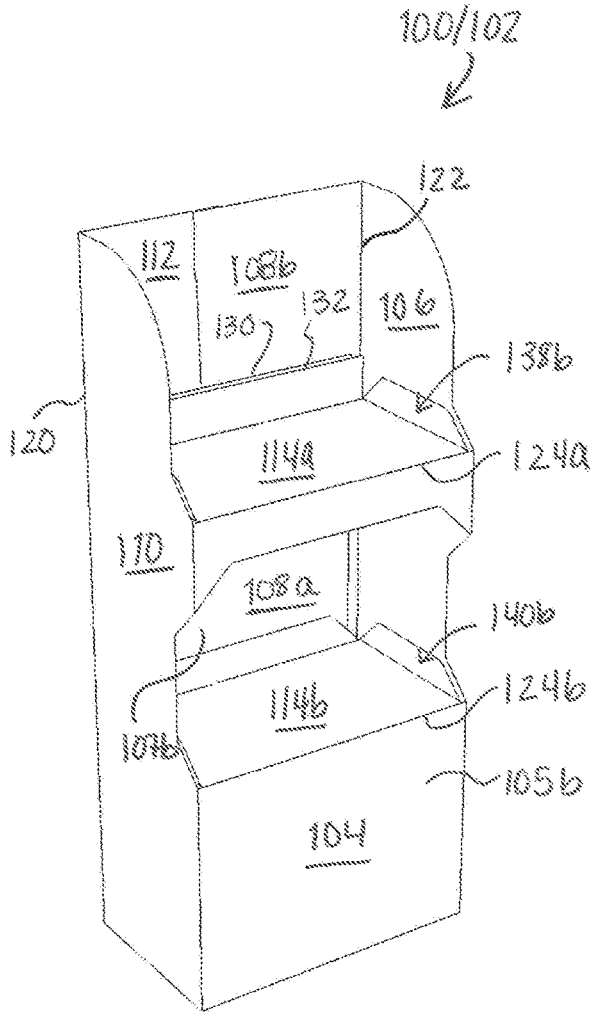
FIG. 10 is an upright front perspective view of the container of FIGS. 6A and 6B, with the first back portion and shelf panels fully slid down with respect to the second back panel portion.

With continued reference to FIGS. 1 and 2, first side panel 106 is connected to the front panel 104 along a fold line 116. FIGS. 1 and 2 show an interior facing surface 105*a* of front panel 104, exterior facing surface 105*b* is shown in FIGS. 8-10. Front panel 104, as described throughout the description below, is inclusive of an upper portion 104'. Second side panel 110 is connected to front panel 104 along a fold line 118 opposite from first side panel 106. Fold line 118 between front panel 104 and second side panel 110 similarly extends between upper portion 104' and fold line 116 similarly extends between upper portion 104' and first side panel 106. Blank 100 includes an adhesion flap 112 foldably connected to second side panel 110 along a fold line 120. Second back portion 108*b* of back panel 108 is foldably connected to first side panel 106 along a fold line 122.

As shown in FIGS. 1 and 2, blank 100 includes shelf panels 114*a* and 114*b* that are foldably connected to front panel 104. Shelf panels 114*a* and 114*b* include respective shelf adhesion flaps 126*a* and 126*b* foldably connected to their respective shelf panel 114*a* and 114*b*. Shelf adhesion flap 126*a* is connected to shelf panel 114*a* along fold line 142*a*. Shelf adhesion flap 126*b* is foldably connected to shelf panel 114*b* along fold line 142*b*. A top edge 130 of first back portion 108*a* is flush with a top edge 132 of shelf adhesion flap 126*a*.

With continued reference to FIGS. 1 and 2, shelf panel 114*a* includes shelf side flaps 138*a* and 138*b* and shelf panel 114*b* includes shelf side flaps 140*a* and 140*b*. Shelf side flaps 138*a* and 138*b* are foldably connected to shelf panel 114*a* along respective fold lines 144*a* and 144*b*. Shelf side flaps 140*a* and 140*b* are foldably connected to shelf panel 114*b* along respective fold lines 146*a* and 146*b*. Shelf panel 114*a* (and its associated flaps described above) is separated from side panels 106 and 110 by way of respective cuts 115*a* and 115*b*. Shelf panel 114*b* (and its associated flaps described above) is separated from side panels 106 and 110 and front panel 114 by way of cut 113. Shelf adhesion flaps 126*a* and 126*b* include respective interior surfaces 128*a* and 128*b*. Adhesion materials, such as glue, are applied to the interior surfaces 128*a* and 128*b*. Glue can be applied in the form of glue dots shown schematically by solid dots on surfaces 128*a* and 128*b* in FIG. 2.

Figure 3:
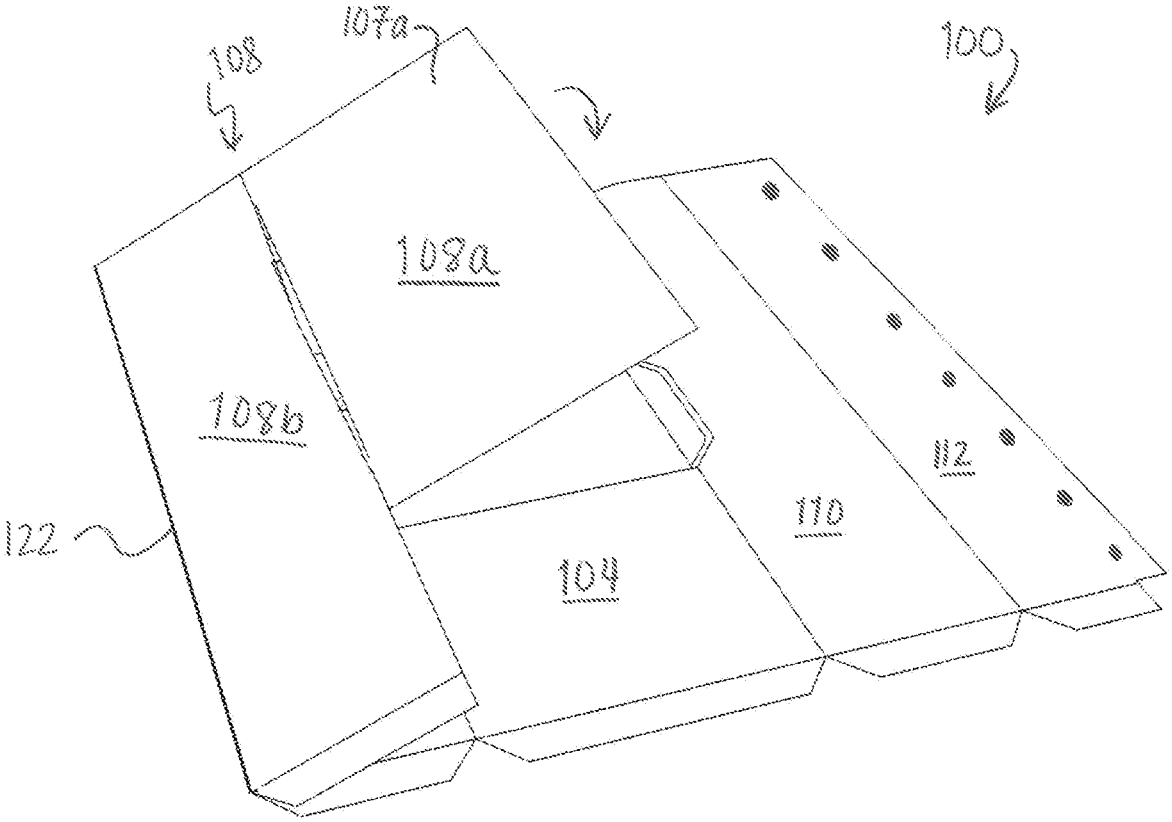
FIG. 3 is a perspective view of the blank of FIG. 1, showing the back panel being folded over onto the side and front panels.
Figure 4:
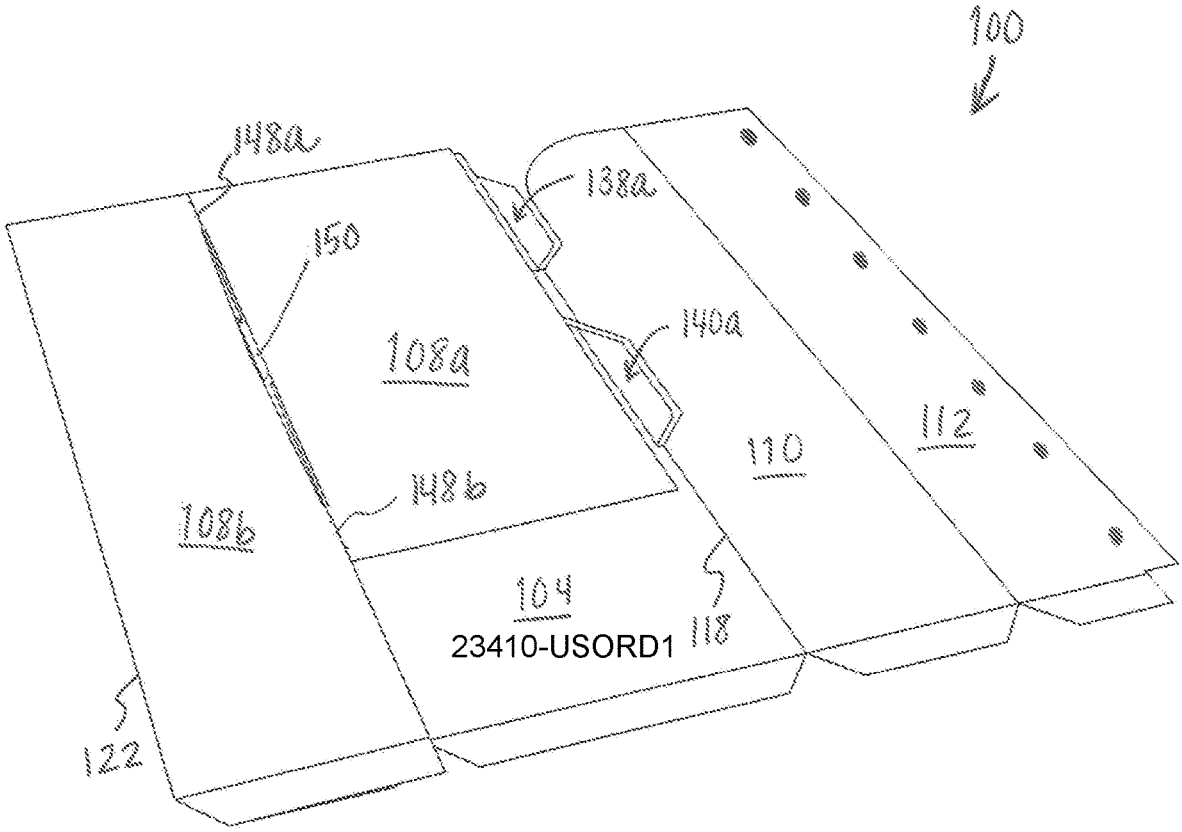
FIG. 4 is a perspective view of the blank of FIG. 1, showing the back panel folded onto the side and front panels.

As shown in FIG. 3-4, after back panel 108 is folded about fold line 122, an exterior surface 107*b* of first back portion 108*a* is adhered to interior surfaces 128*a* and 128*b* of shelf adhesion flaps 126*a* and 126*b*. First back portion 108*a* includes an interior surface 107*a* that faces an interior surface 111*a* of second back portion 108*b* and adhesion flap 112 when assembled. First back portion 108*a* has a length $L_1$ in the longitudinal direction of the container and second back portion 108*b* has a length $L_2$ in the longitudinal direction. Length $L_1$ of first back portion 108*a* is less than the length $L_2$ of second back portion 108*b*.

Figure 5:
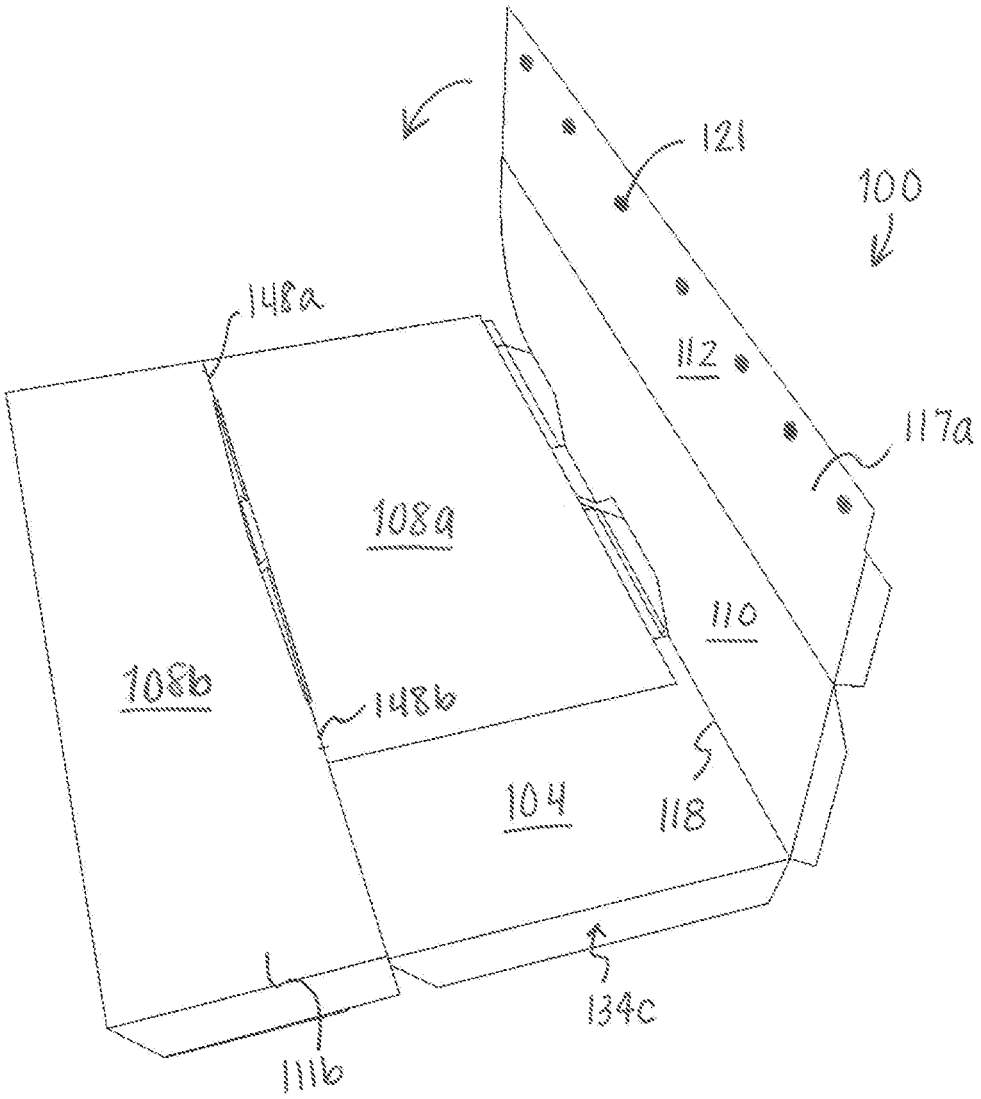
FIG. 5 is a perspective view of the blank of FIG. 1, showing the side panel and the adhesion flap being folded over onto the back panel.
Figure 6B:
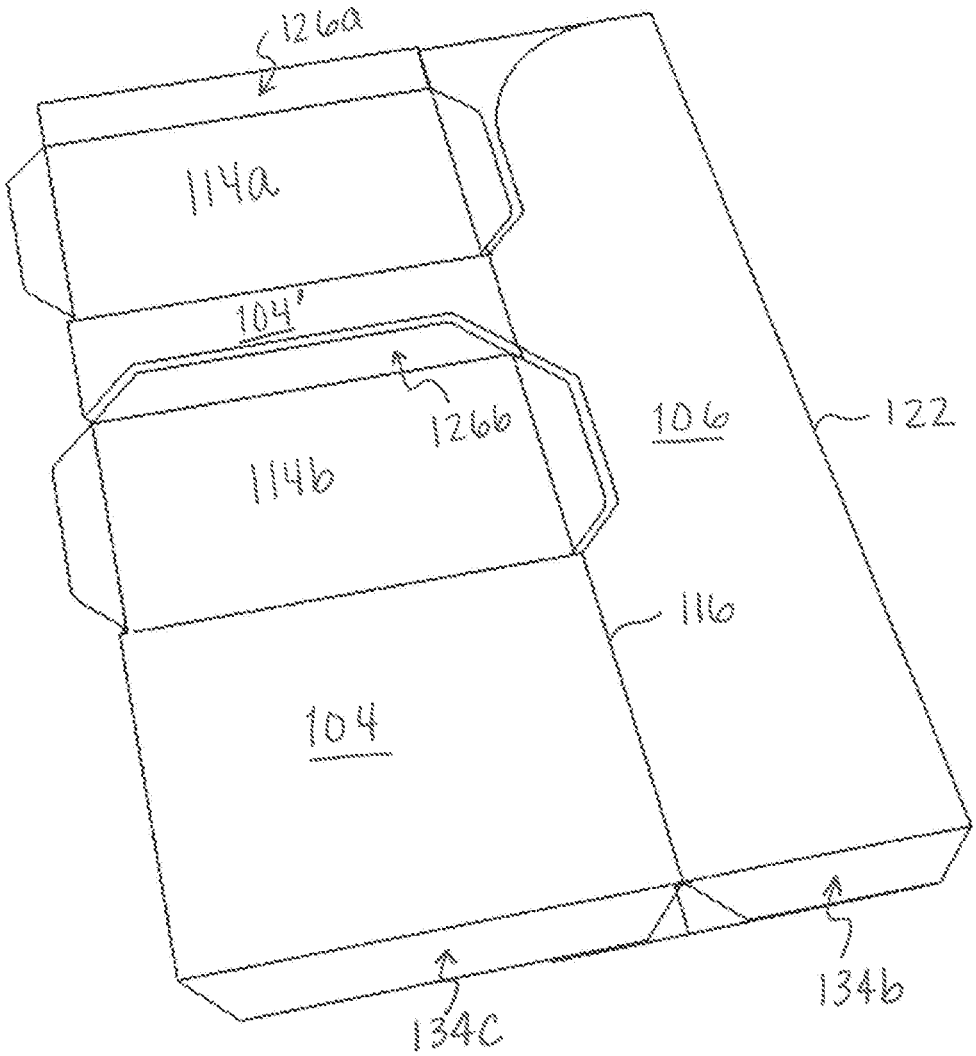
FIG. 6B is a perspective view of the blank of FIG. 1 formed into a container, showing the container from its front side in a flattened position.

As shown in FIG. 5-6B, second side panel 110 is folded along fold line 118 and adhesion flap 112 overlaps second back portion 108*b* of the back panel 108. Adhesion flap 112 is adhered to an exterior surface 111*b* of second back portion 108*b* of back panel 108 along a adhesion line, e.g. a glue line. This glue line can include one or more glue dots 121 between an interior surface of adhesion flap 112 and exterior surface 111*b* of second back portion, as indicated schematically by the solid dots of FIGS. 2-5 on an interior surface 117*a* of an adhesion flap 112. It is contemplated that glue dots 121 on flap 112 and flaps 126*a* and 126*b* can be applied to the surfaces as shown at the same time, and then the folds at 122 and 118 can take place. It is also contemplated that other suitable adhesion techniques and materials can be used. The glue on adhesion flap 112 and shelf adhesion flaps 126*a* and 126*b* and can be applied by way of a straight line gluing, as opposed to requiring special machine gluing.

As shown in FIGS. 9-10, first back portion 108*a* is slidable with respect to second back portion 108*b*. First back portion 108*a* is configured to slide between a first position (e.g. where a top edge of first back portion 108*a* is approximately at the same position as a top edge of second back portion 108*b*), and a second position (e.g. where a bottom edge of first back portion 108*a* is approximately at the same position as a bottom edge of front panel 104. The sliding of first back portion 108*a* can be achieved by folding the shelf panels 114*a* and/or 114*b* along respective fold lines 124*a* and 124*b* toward back panel 108, by pushing first back portion 108*a* downward, or both. This folding/pushing also folds shelf side flaps 140*a* and 140*b* along their respective fold lines 146*a* and 146*b* with respect to shelf panel 114*b* and folds shelf side flaps 138*a* and 138*b* along their respective fold lines 144*a* and 144*b*. When container 102 is erected, respective interior surfaces 141*a* and 141*b* of shelf side flaps 140*a* and 140*b* abut interior surfaces of second and first side panels 110 and 106, respectively. Respective interior surfaces 143*a* and 143*b* of shelf side flaps 138*a* and 138*b* abut interior surfaces of second and first side panels 110 and 106, respectively.

With reference now to FIGS. 3-10, a method of forming a container includes securing first back portion 108*a* to at least one of the shelf panels 114*a* and 114*b*, e.g. by folding back panel 108 about fold line 122, shown in FIG. 3. Securing the panels can be done by adhering exterior surface 107*b* of first back portion 108*a* to one or more of shelf panels 114*a* and 114*b*. The method includes separating first back portion 108*a* from second back portion 108*b* along the break line, e.g. first and second perforations 148*a* and 148*b*. The method includes folding second side panel 110 along fold line 118 between the second back portion 108*b* and the front panel 104, as shown in FIG. 5. Those skilled in the art will readily appreciate that separating first back portion 108*a* from second back portion 108*b* can be done before or after folding second side panel along fold line 118.

The method includes adhering an interior surface 117*a* of an adhesion flap 112 to an exterior surface 111*b* of second back portion 108*b*. Exterior surface 117*b* of adhesion flap 112 is shown in FIG. 6A. The combined container 102, shown in FIGS. 6A-6B, can then be erected at a retail location, or in another suitable location. As shown in FIGS. 7-8, erecting container 102 includes folding front panel 104 with respect to first side panel 106 about fold line 116 and folding adhesion flap 112 with respect to second side panel 110 along fold line 120 to form a generally rectangular shape about interior space 119. FIG. 7 shows a partially popped-up/erected container and FIG. 8 shows the container fully popped-up with end flaps 134*a*-134*e* folded inward and shelves 114*a* and 114*b* folded and slid down into place (sliding described in more detail with respect to FIGS. 9-10, below).

With reference now to FIGS. 9-10, once erected (or concurrently therewith) the method includes sliding first back portion 108*a* downward and folding the shelf panel 114*a* along a fold line between the shelf panel 114*a* and the front panel 104, this sliding is indicated schematically by the downward pointing arrows of 108*b*. As shown in FIG. 10, once first back portion 108*a* is slid down to abut interior surfaces 135*a* and 135*e* of end flaps 134*a* and 134*e*, respectively, shelves 114*a* and 114*b* can be stacked with product as desired. While shown and described in the exemplary context of a hutch-style display container, those skilled in the art will readily appreciation that any other suitable container style can be formed without departing from the scope of this disclosure. Blanks and containers as disclosed herein can be constructed of any suitable material such as corrugated paper board.

The methods and systems of the present disclosure, as described above and shown in the drawings, provide for containers with superior properties including ease of manufacturing due to the capability for straight line gluing, and quick pop-up at a retail location. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A container comprising:

a plurality of panels connected together at fold lines configured for extending at least partially around an interior space, including a front panel, a first side panel, a back panel and a second side panel, wherein the back panel includes:

a first back portion; and a second back portion, wherein the first back portion is connected to the second back portion along a break line; and a shelf panel foldably connected to the front panel, wherein the first back portion is adhered to the shelf panel;

wherein the first back portion has a first length defined between a top edge of the first back portion and a bottom edge of the first back portion, wherein the second back portion has a second length defined between a top edge of the second back portion and a bottom edge of the second back portion, wherein said first length is less than said second length;

wherein the second back portion has a first width defined between opposing sides of the second back portion, wherein the first side panel has a second width defined between opposing sides of the first side panel, wherein the first width is substantially equal to the second width.

2. The container as recited in claim 1, wherein the first side panel is connected to the front panel along a respective one of the fold lines, and wherein the second side panel is connected to the front panel along a respective one of the fold lines opposite from the first side panel.

3. The container as recited in claim 1, further comprising an adhesion flap foldably connected to the second side panel along a fold line.

4. The container as recited in claim 3, wherein the adhesion flap overlaps the second back portion of the back panel.

5. The container as recited in claim 3, wherein the adhesion flap is adhered to an exterior surface of the second back portion of the back panel.

6. The container as recited in claim 1, wherein the second back portion is foldably connected to the first side panel along a fold line.

7. The container as recited in claim 1, wherein the first back portion has a length in the longitudinal direction of the container and the front panel has a length in the longitudinal direction, wherein the length of the first back portion is less than the length of the front panel.

8. The container as recited in claim 1, wherein the first back portion is configured to slide between a first position and a second position thereby folding the shelf panel along a fold line between the shelf panel and the front panel.

9. The container as recited in claim 1, the shelf panel includes a shelf adhesion flap foldably connected to the shelf panel, wherein an interior surface of the shelf adhesion flap is adhered to an interior surface of the first back portion.

10. The container as recited in claim 9, wherein a top edge of the first back portion is flush with a top edge of the shelf adhesion flap.

11. The container as recited in claim 1, a plurality of end flaps, each end flap foldably connected to a respective one of the plurality of panels.

12. A blank for a container comprising:

a plurality of panels connected together along respective fold lines configured to be folded at least partially around an interior space, including a front panel, a first side panel, a back panel and a second side panel, wherein the back panel includes:

a first back portion; and a second back portion, wherein the first back portion is connected to the second back portion along a break line;

wherein the first side panel is connected to the second back portion along a first fold line, wherein the first side panel is connected to the front panel along a second fold line, wherein the first side panel has a first width defined between the first and second fold lines, wherein the second back portion has a second width defined between the break line and the first fold line, wherein the first width is substantially equal to the second width; wherein the first back portion has a first length defined between a top edge of the first back portion and a bottom edge of the first back portion, wherein the second back portion has a second length defined between a top edge of the second back portion and a bottom edge of the second back portion, wherein said first length is less than said second length.

13. The blank as recited in claim 12, wherein a width of the first back portion is substantially equal to a width of the front panel.

14. The blank as recited in claim 12, wherein the second side panel is connected to the front panel along a third fold line.

15. The blank as recited in claim 14, further comprising an adhesion flap connected to the second side panel along a fourth fold line.

16. The blank as recited in claim 12, further comprising a shelf panel connected to the front panel along a fold line.

17. The blank as recited in claim 12, wherein the break line is weakened to facilitate breaking the second back portion from the first back portion by at least one of a knife cut and/or perforations.

18. The blank as recited in claim 12, wherein the break line is a first break line, and wherein the first back portion is connected to the second back portion along the first break line and a second break line, wherein the blank includes a cut portion between the first and second break lines.

19. A method of forming a container comprising:

folding a plurality of panels of a blank connected together at fold lines at least partially around an interior space, wherein the panels include a front panel, a first side panel, a back panel and a second side panel, wherein the back panel includes a first back portion and a second back portion;

adhering the first back portion to a shelf panel; and separating the first back portion from the second back portion along a break line;

wherein the first side panel is connected to the second back portion along a first fold line, wherein the first side panel is connected to the front panel along a second fold line, wherein the first side panel has a first width defined between the first and second fold lines, wherein the second back portion has a second width defined between the break line and the first fold line, wherein the first width is substantially equal to the second width; wherein the first back portion has a first length defined between a top edge of the first back portion and a bottom edge of the first back portion, wherein the second back portion has a second length defined between a top edge of the second back portion and a bottom edge of the second back portion, wherein said first length is less than said second length.

20. The method as recited in claim 19, further comprising adhering an interior surface of an adhesion flap to an exterior surface of the second back portion.

21. The method as recited in claim 19, further comprising sliding the first back portion downward relative to the second back portion and folding the shelf panel along a fold line between the shelf panel and the front panel.

* * * * *